United States Patent [19]

Löw

[11] Patent Number: 5,042,131

[45] Date of Patent: Aug. 27, 1991

[54] RIVET SETTING APPARATUS WITH AUTOMATIC RIVET FEED

[75] Inventor: Karl Löw, Benningen, Fed. Rep. of Germany

[73] Assignee: Alfred Honsel Nietan- und Metallwarenfabrik GmbH & Co., Frondenberg, Fed. Rep. of Germany

[21] Appl. No.: 612,129

[22] Filed: Nov. 9, 1990

[51] Int. Cl.[5] ..... B21J 15/32

[52] U.S. Cl. ..... 29/243.521; 72/391.6; 72/453.17; 227/112

[58] Field of Search ..... 29/243.521, 243.523, 29/243.525; 72/391.6, 453.17, 391.2; 227/112

[56] References Cited

U.S. PATENT DOCUMENTS

| | | | |
|---|---|---|---|
| 3,049,713 | 8/1962 | Dupuy et al. | 227/112 |
| 4,220,033 | 9/1980 | Powderley | 72/391.6 |
| 4,604,889 | 8/1986 | Sukharevsky | 29/243.525 |
| 4,630,460 | 12/1986 | Mauer | 29/243.525 |
| 4,747,294 | 5/1988 | Schwartz et al. | 227/112 |
| 4,852,376 | 8/1989 | Suhou | 72/453.17 |

FOREIGN PATENT DOCUMENTS

| | | |
|---|---|---|
| 2441707 | 3/1976 | Fed. Rep. of Germany . |
| 2171627 | 9/1886 | United Kingdom . |

*Primary Examiner*—David Jones

*Attorney, Agent, or Firm*—Barnes, Kisselle, Raisch, Choate, Whittemore & Hulbert

[57] ABSTRACT

A rivet setting tool includes an arrangement for feeding rivet members to the riveting head which contains the rivet clamping jaws, including a conveyor conduit for feeding the rivet members to the riveting head. The conveyor conduit has a conduit end portion which is pivotable in relation to the body of the tool into a position for feeding a rivet member into a transfer passage in front of the riveting head, the rivet head then moving into the transfer passage to pick up the rivet member fed by the conveyor conduit. The conveyor conduit end portion is pivoted out of the transfer passage during the forward movement of the riveting head.

12 Claims, 2 Drawing Sheets

RIVET SETTING APPARATUS WITH AUTOMATIC RIVET FEED

BACKGROUND OF THE INVENTION

A rivet setting apparatus or tool for setting blind rivets or rivet nuts may typically comprise a device for feeding the blind rivets or rivet nuts, which may be referred to hereinafter for the sake of simplicity as rivet members, to a riveting head which forms part of the rivet setting apparatus and which includes rivet member clamping jaws, together with a conveyor conduit for carrying the rivet members to the riveting head. When handling a rivet setting tool of that kind, rivet members in the form of blind rivets may be introduced into the mouthpiece or tip portion of the tool by hand, or blind rivets may be screwed on by means of the apparatus. The procedure involved in such circumstances however is complicated and time-consuming so that rivet setting apparatuses involving an automatic rivet member feed have also been designed.

U.S. Pat. No. 4,220,033 discloses an apparatus involving a rivet feed arrangement, but that design configuration is considered to suffer from the disadvantage that the mouthpiece or tip portion of the apparatus is designed to be pivoted open, in order to accommodate the rivet members.

An apparatus as disclosed in British patent specification No. 2 171 627 also operates in a similar manner, while special rivets of a specific configuration are also required.

An automatic blind riveting apparatus as set forth in German laid-open application (DE-OS) No. 24 41 707 also requires special rivets, and the mouthpiece or tip portion of the tool must also open up.

The above-discussed apparatuses are thus of complicated constructions and also tend to suffer from an unreliability factor in operation thereof.

SUMMARY OF THE INVENTION

An object of the present invention is to provide an improved automatic rivet setting apparatus which involves an inexpensive design configuration and which is reliable in operation.

Another object of the present invention is to provide a rivet setting apparatus with rivet member feed which operates in a reliable fashion to provide a ready supply of rivet members as required.

Yet another object of the present invention is to provide a rivet setting apparatus with rivet feed, which involves simple movements in operation thereof.

In accordance with the present invention these and other objects are achieved by a rivet setting apparatus comprising a means for feeding rivet members such as blind rivets or nuts to the riveting head of the apparatus, which includes rivet member clamping jaws, together with a rivet member conveyor conduit leading to the riveting head for feeding rivet members thereto. The rivet member conveyor conduit has a special conveyor conduit end portion which is adapted to be pivotable in relation to the body of the rivet setting tool. The conveyor conduit end portion is adapted to pivot into a transfer passage in a first advanced position relative to the head, in front of same, while in a second retracted position of the transfer passage the conveyor conduit end portion is pivoted out of same.

In a preferred feature of the invention, the transfer passage is advantageously provided with jaws which are adapted to be laterally pivoted out of same.

In accordance with another preferred feature of the invention, the jaws close off the transfer passage in a forward direction and in the rearward movement of the assembly towards the second retracted position of the transfer passage, apply the rivet to the tip portion of the apparatus on the outside thereof.

Another preferred feature may provide that the transfer passage is provided in the jaws. To assist with the transfer operation, the riveting head and a guide sleeve member on which the riveting head is slidable are connected at their rearward end remote from the tip portion of the tool, to a suction conduit.

In yet another preferred feature, upon the rearward movement of the transfer passage, the riveting head is operable to pivot the jaws outwardly towards the side, by the tip portion of the riveting head passing through between the jaws. In that arrangement it may advantageously be provided that the forward movement of the riveting head deflects the conveyor conduit end portion outwardly and more especially upwardly.

In the arrangement of the invention, in accordance with a preferred feature, the conveyor conduit end portion may be mounted on a pivotal member which is rotatable about an axis, wherein the conveyor conduit end portion is displaced downwardly by virtue of the force of gravity acting thereon, or is urged downwardly by a coil spring.

In another preferred feature of the invention the jaws are combined together to provide a feed slider which is slidable on the guide sleeve member on which the riveting head is suitably carried. The jaws are advantageously secured to the feed slider by way of leaf springs.

Further objects, features and advantages of the present invention will be apparent from the following description of a preferred embodiment thereof.

DESCRIPTION OF A PREFERRED EMBODIMENT

Figure 1:
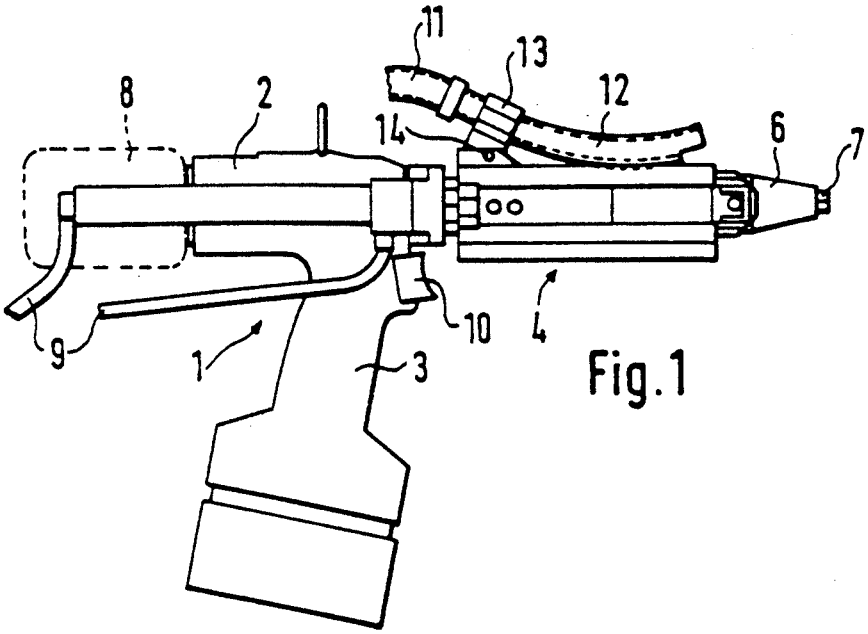
FIG. 1 is a partly sectional side view of a rivet setting apparatus according to the invention.

Referring firstly to FIG. 1, shown therein is a rivet setting apparatus or tool 1 which essentially comprises an upper body portion 2, a handle portion 3 which extends downwardly from the body portion 2, and a rivet feed arrangement 4. Disposed in the upper body portion 2 of the apparatus 1 is an operating piston (not shown) provided with an operating piston rod which, as can be seen from FIG. 2, extends through a guide sleeve member 5 as far as a riveting head 6 and carries clamping jaws of the rivet setting apparatus 1, at the front end of the riveting head 6. The rivet head 6 is carried on the guide sleeve member 5.

A pressure piston is provided in the handle portion 3 while a container 8 shown in broken lines in FIG. 1 is disposed at the rearward end of the upper body portion 2 of the apparatus, for catching rivet pins which have been torn off rivet members after setting thereof. Reference numeral 9 in FIG. 1 identifies compressed air and suction conduits. Reference numeral 10 in FIG. 1 identifies a trigger for actuating the rivet setting apparatus.

Figure 3:
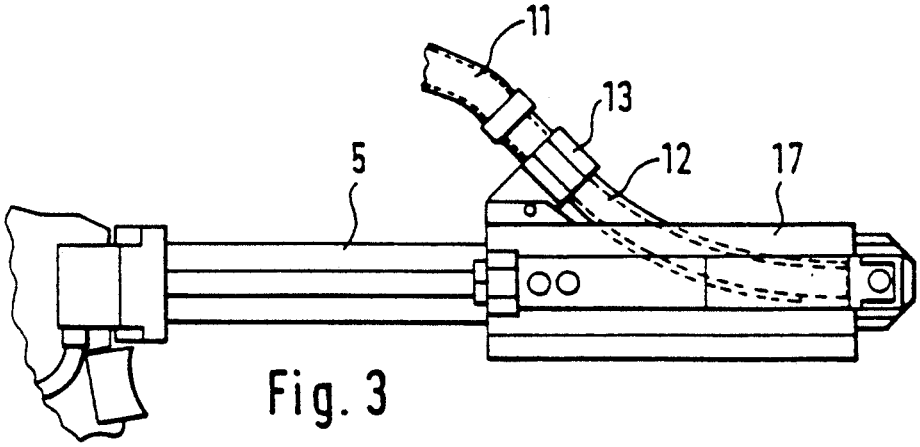
FIG. 3 is a side view of the front part of the apparatus shown in FIG. 1, with the rivet member conveyor conduit in the feed position.

As can be seen in detail from FIG. 1, the rivet setting apparatus further includes a conveyor conduit 11 for providing for the feed of rivet members such as blind or rivet nuts, the conveyor conduit 11 including at its free end which is towards the right in FIG. 1, a conveyor conduit end portion 12 of a particular configuration, being inter alia of a curved shape as can be clearly seen from both FIGS. 1 and 3. The conveyor conduit end portion 12 is secured to a pivotal member 13 which is mounted rotatably about an axis indicated at 14 in FIG. 1. FIG. 1 shows the conveyor conduit end portion 12 in a position in which it has been moved by a pivotal motion out of a rivet member feed passage which is indicated at 15 in FIG. 4 and which is illustrated in FIG. 1 in a retracted position on the guide sleeve member 5.

Figure 2:
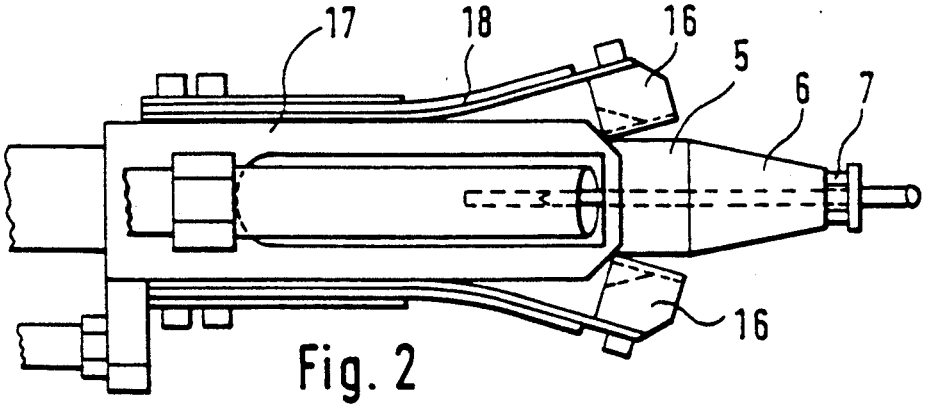
FIG. 2 is a plan view of the front part of the apparatus shown in FIG. 1.

Reference will be made at this stage to FIG. 2 showing a position of the rivet setting apparatus in which jaws 16 which close off the conveyor or transfer passage in a forward direction, that is to say towards the right in FIGS. 1 through 3, are pivoted outwardly towards respective sides of the riveting head, by the riveting head 6 with its tip portion 7 moving forwardly between the jaws 16. The jaws 16 are combined together to provide a slider which is generally identified by reference numeral 17 in FIGS. 2 through 4 and which is disposed slidably on the guide sleeve member 5. It will be seen therefore that the jaws 16 which are operable to hold a rivet member to be set, in a position in front of the riveting head 6 with tip portion 7, can be moved aside to permit the rivet member to be received in the tip portion 7, by sliding the slider 17 along the guide sleeve member 5 towards the left for example in FIG. 2, or alternatively by advancing the riveting head 6 with tip portion 7 through the slider 17, towards the right for example in FIG. 2.

The jaws 16 are mounted to the slider 17 by means of respective leaf springs 18 so the jaws 16 can be pivoted aside in a manner which is simple from the structure point of view, when the riveting head 6 with tip portion 7 advances between the jaws 16.

Figure 4:
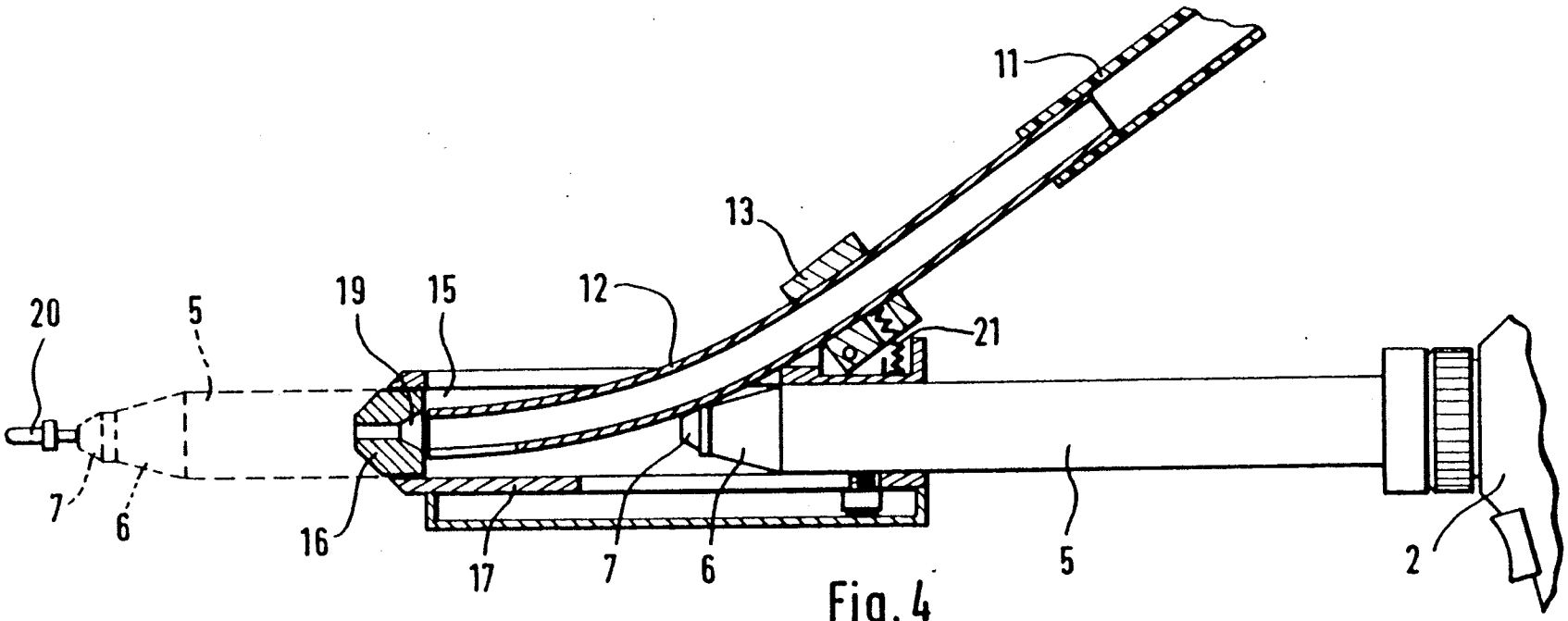
FIG. 4 is a partly sectional view corresponding to that shown in FIG. 3.

After a riveting operation has been carried out, the slider 17 and therewith the transfer passage 15 are moved forwardly on the guide sleeve member 5 and as that movement takes place, the conveyor conduit end portion 12 pivots into the transfer passage 15, thus taking up the position shown in FIG. 3 in broken lines and shown in FIG. 4 in section. In that position of the apparatus, the jaws 16 pivot inwardly and close off the transfer passage 15 in a forward direction, that is to say towards the left in FIG. 4. As FIG. 4 shows, the conveyor conduit end portion 12 pivots into position directly rearwardly of the jaws 16, that is to say towards the right thereof in FIG. 4. The jaws 16 define a recess 19 of the configuration shown in FIG. 4, to serve as a part of the transfer passage and to receive a rivet when it is supplied thereto from the conveyor conduit 11 by way of the conveyor conduit end portion 12. As soon as the rivet member has been fed to the jaws 16 and is carried in the recess 19, the slider 17 is moved on the guide sleeve member 5 back into the retracted position, that is to say towards the right in FIG. 4, or alternatively the riveting head 6 with guide sleeve member 5 is displaced towards the left in FIG. 4 through the slider 17 into the riveting head position shown in broken lines towards the left in FIG. 4. During that movement the riveting head 6 causes the conveyor conduit end portion 12 to pivot out of the transfer passage 15, and thus into the position shown in FIG. 1, while the rivet 20 which is carried in the recess 19 of the jaws 16 is introduced into the hole of the tip portion 7 of the riveting head 6, as shown in FIG. 4. The apparatus is then in a ready condition for carrying out a riveting operation.

After the riveting operation has been performed, the rivet pin which has been torn off the set rivet is then conveyed into the collecting container 8 by a suction duct disposed within the interior of the rivet setting apparatus. The slider 17 is then moved forwardly again into the position shown in FIGS. 3 and 4 so that the conveyor conduit end portion 12 can again assume the position shown in FIGS. 3 and 4.

It will be noted in that respect that, with the conveyor conduit end portion 12 disposed above the riveting head 6, in the normal position of operation of the rivet setting apparatus, the conveyor conduit end portion 12 can be caused to pivot down into the transfer passage 15 to feed a rivet member to the jaws 16, by virtue of the weight of the conveyor conduit end portion 12, under the effect of the force of gravity. It is also possible however for the rivet setting apparatus to include a spring such as the coil spring indicated at 21 in FIG. 4, to assist with the movement of the conveyor conduit end portion 12 into the operative position thereof as shown in FIGS. 3 and 4.

It will be seen that the above-described rivet setting apparatus with rivet member feed arrangement is suitable in particular for use with blind or rivets nuts, and it is reliable in operation, while being of an uncomplicated structural configuration, and also suffers from virtually no wear in the course of operation of the apparatus.

It will be appreciated that the above-described embodiment has been set forth solely by way of example and illustration of the principles of the present invention and that various modifications and alterations may be made therein without thereby departing from the spirit and scope of the invention.

What is claimed is:

1. A rivet setting apparatus for setting rivet member comprising: a riveting head including rivet member clamping jaws; and a means for feeding rivet members to the riveting head, including a transfer passage means operatively associated with the rivet head, slide means providing for slidable relative displacement of said rivet head and said transfer passage means between a first position in which said transfer passage means is disposed forwardly of said riveting head and a second position in which said transfer passage means is retracted in relation to said riveting head, and a conveyor conduit for feeding rivet members to said transfer passages means, the conveyor conduit including an end portion adapted to be pivotable by the rivet head between a first position in which it is pivoted to into said transfer passage means in said first position of the transfer passage means and a second position in which said end portion is pivoted to retract from said transfer passage means, the relative displacement between said transfer passage means and said riveting head towards said second position of the transfer passage means causing said conveyor conduit end portion to be pivoted upwardly into its second position.

2. A tool as set forth in claim 1 wherein said transfer passage means further includes jaw means for holding a rivet member and adapted to be laterally pivoted out of said transfer passage means.

3. A tool as set forth in claim 2 wherein said jaw means in a closed position close off said transfer passage means in a forward direction and are operable to fit a rivet member to said riveting head upon relative movement of said transfer passage means and said riveting head towards said second position of said transfer passage means.

4. A tool as set forth in claim 2 wherein said jaw means include a passage for receiving a rivet member fed thereto.

5. A tool as set forth in claim 1 and further including a suction conduit connected to the rearward end of said riveting head.

6. A tool as set forth in claim 1 wherein relative displacement between said transfer passage means and said riveting head towards said second position of the transfer passage means causes said conveyor conduit end portion to be pivoted upwardly into its second position.

7. A tool as set forth in claim 1 and further including a pivotal member carrying said conveyor conduit end portion for pivotal movement between said first and second position thereof.

8. A tool as set forth in claim 1 and further including a coil spring operable to urge said conveyor conduit end portion towards the first position thereof.

9. A tool as set forth in claim 1 wherein said conveyor conduit end portion is so positioned as to be urged downwardly towards said first position thereof by the force of gravity.

10. A tool as set forth in claim 2 including a slider providing said transfer passage means and carrying said jaw means, and further including a guide member which carries said riveting head and on which said slider is slidable.

11. A tool as set forth in claim 9 and including leaf spring means mounting said jaw means to said slider.

12. A rivet setting apparatus for setting rivet members comprising: a body portion including a handle for holding the apparatus and having a forward end and a rearward end; a guide member extending forwardly from said forward end of said body portion and having a forward end; a riveting head carried at said forward end of said guide member and including jaws for setting a said rivet member; a slider slidably carried on said guide member and displaceable thereon between a retracted position in which said riveting head projects forwardly from said slider and an extended position in which said slider extends beyond said riveting head; jaw members carried by said slider and so disposed that in said extended position of said slider said jaw members are disposed in front of said riveting head; a passage means within said slider and communicating with said jaw members rearwardly thereof; a conveyor conduit for feeding rivet members towards said slider, said conveyor conduit including a rivet member feed end portion; and means mounting said conveyor conduit end portion on said slider pivotably between a position in which said conveyor conduit end portion is disposed in said passage in said slider for feeding a rivet member to said jaw members, and a position in which said conveyor conduit end portion is outside said slider.

* * * * *